United States Patent [19]

Webb

[11] Patent Number: 5,056,779

[45] Date of Patent: Oct. 15, 1991

[54] TORSO EXERCISE MACHINE WITH RANGE LIMITER

[75] Inventor: Gregory M. Webb, Independence, Va.

[73] Assignee: Nautilus Acquisition Corporation, Independence, Va.

[21] Appl. No.: 555,989

[22] Filed: Jul. 20, 1990

[51] Int. Cl.[5] ..... A63B 21/00

[52] U.S. Cl. ..... 272/134; 272/118

[58] Field of Search ..... 272/117, 118, 123, 129, 272/130, 132, 134, 136, 142, 143

[56] References Cited

U.S. PATENT DOCUMENTS

| | | | |
|---|---|---|---|
| 4,336,934 | 6/1982 | Hanagan et al. | 272/117 X |
| 4,600,196 | 7/1986 | Jones | 272/134 |
| 4,725,056 | 2/1988 | Behrl et al. | 272/134 |
| 4,836,536 | 6/1989 | Jones | 272/134 |
| 4,838,548 | 6/1989 | Maam | 272/117 X |
| 4,986,538 | 1/1991 | Isu, III | 272/118 X |

*Primary Examiner*—Robert Bahr

*Attorney, Agent, or Firm*—Bell, Seltzer, Park & Gibson

[57] ABSTRACT

A torso exercise machine includes a seat connected to a frame for supporting a user thereon. An upper body engaging member receives force from an upper body part for exercising the torso. The upper body engaging member is pivotally mounted to the frame for pivotal movement along an eccentric path of travel while generating an instantaneous axis of rotation substantially along the torso and spine of the seated user. The eccentric path of travel of the upper body engaging member is illustrated as being obtained by pivotally mounted the upper body engaging member to the frame by a four-bar linkage. A resistance weight opposes movement of the user while the user exercises. A range limiter is provided to reduce the normal range of back and forth movement of the upper body engaging member.

28 Claims, 6 Drawing Sheets

TORSO EXERCISE MACHINE WITH RANGE LIMITER

FIELD OF THE INVENTION

This invention relates to torso exercise machines, and more particularly to an exercise machine having an upper body engaging member moveable along an eccentric path of travel for receiving force from a body part of a user and a range limiter for varying the starting position of the upper body engaging member and thereby reducing the range of movement along the path of travel.

BACKGROUND OF THE INVENTION

On most prior art exercise machines, when exercising the torso muscles such as the abdominal and lower back muscles, the user engages an upper body engaging member of the machine and exerts back and forth force thereagainst so that the spine of the user partially rotates around several vertebrae. During these back and forth movements, the axis of rotation of the user moves vertically along the spine.

Heretofore, most prior art exercise machines for exercising the abdominal and lower back muscles have been constructed to include a body engaging member moveable in a back and forth semi-circular path of travel which is always the same distance from the rotational axis. For example, in commonly assigned U.S. Pat. Nos. 4,500,089 and 4,387,893, the body engaging member is mounted on the outer end of a user actuated lever. The inner end of the user actuated lever is pivotally connected to the machine frame so that the body engaging member is moved back and forth along a semi-circular path of travel. During the back and forth exercise movements, the lever rotates about a fixed axis of rotation. The maximum exercise efficiency is not obtained because the actual axis of rotation of the body moves vertically along the spine during the back and forth movements while the semi-circular movement of the body engaging member does not compensate for the movement of the rotational axis along the vertebrae of the spine. This prior art type of exercise machine causes rotation around the hips instead of the desired rotational movement along the spine.

Additionally, in most prior art exercise machines such as disclosed in the aforementioned prior art patents, no means is provided for limiting the range of the body engaging member during the exercise. At times, it is desirable to vary the starting position of the body engaging member and thereby reduce its range of movement. For example, a back injury may necessitate adjusting the exercise machine so that instead of exercising the back with the full range of movement from a forwardly bent position to a rearwardly bent position, only a limited range of back movement is provided to prevent further injury.

SUMMARY OF THE INVENTION

Therefore, it is an object of the present invention to provide a torso exercise machine which overcomes the deficiencies of the prior art.

Another object of the present invention is to provide a torso exercise machine which includes an upper body engaging member adapted for engaging a portion of the upper body of a seated user and receiving force from the upper body part for exercising an isolated portion of the torso, and wherein the upper body engaging member is moveable along a back and forth path of travel so that an instantaneous (moving) axis of rotation is generated substantially along the spinal column, corresponding to the changing axis of rotation of the isolated and exercised torso portion as the user applies back and forth force against the upper body engaging member.

It is still another object of the present invention to provide a range limiter for use in an exercise machine of the aforementioned type for varying the starting position of the body and thereby reducing the range of movement of the body engaging member along the back and forth path of travel.

These and other objects and advantages of the present invention are accomplished by a torso exercise machine which includes an upper body engaging member pivotally mounted about a horizontal pivot axis for back and forth movement along an eccentric path of travel. The eccentric path of travel of the upper body engaging member is obtained by a special pivotal mounting, illustrated as a four-bar linkage mechanism. This four-bar pivotal mounting means includes first and second lever arms having the first ends of each lever arm pivotally mounted in spaced relation to each other on the upper body engaging member. The second ends of the lever arms are pivotally mounted in spaced relation to each other on the frame so that the axis of rotation of the upper body engaging member changes as the upper body engaging member is moved back and forth along the eccentric path of travel.

Resistance means, in the form of a stack of weight, is supported for vertical movement on the frame to provide resistance and oppose back and forth movement of the upper body engaging member by the user while positioned on the seat. Linkage means operatively connects the upper body engaging member to the resistance means for transmitting back and forth movement of the body engaging member to the resistance means. A variable radius cam is rotatable with the body engaging member and is operatively connected to the resistance means for varying the amount of force required to be exerted by the user on the body engaging member in accordance with the position of the body engaging member along the path of travel.

Range limiter means is provided for varying the starting position of the body engaging member and reducing the range of back and forth movement along the path of travel. The range limiter means includes first sprocket means operatively connected to the body engaging member and second sprocket means operatively connected to the resistance means. Pawl means is provided to releasably lock the first sprocket means to the second sprocket means so as to permit the first and second sprocket means to be interconnected in a selected relative rotational orientation to thereby vary the starting position of the body engaging member along the back and forth path of travel.

BRIEF DESCRIPTION OF THE DRAWINGS

Some of the objects and advantages of the present invention having been stated, others will be more fully understood from the detailed description which follows and by reference to the accompanying drawings in which.

DESCRIPTION OF THE PREFERRED EMBODIMENTS

Figures 1, 2:
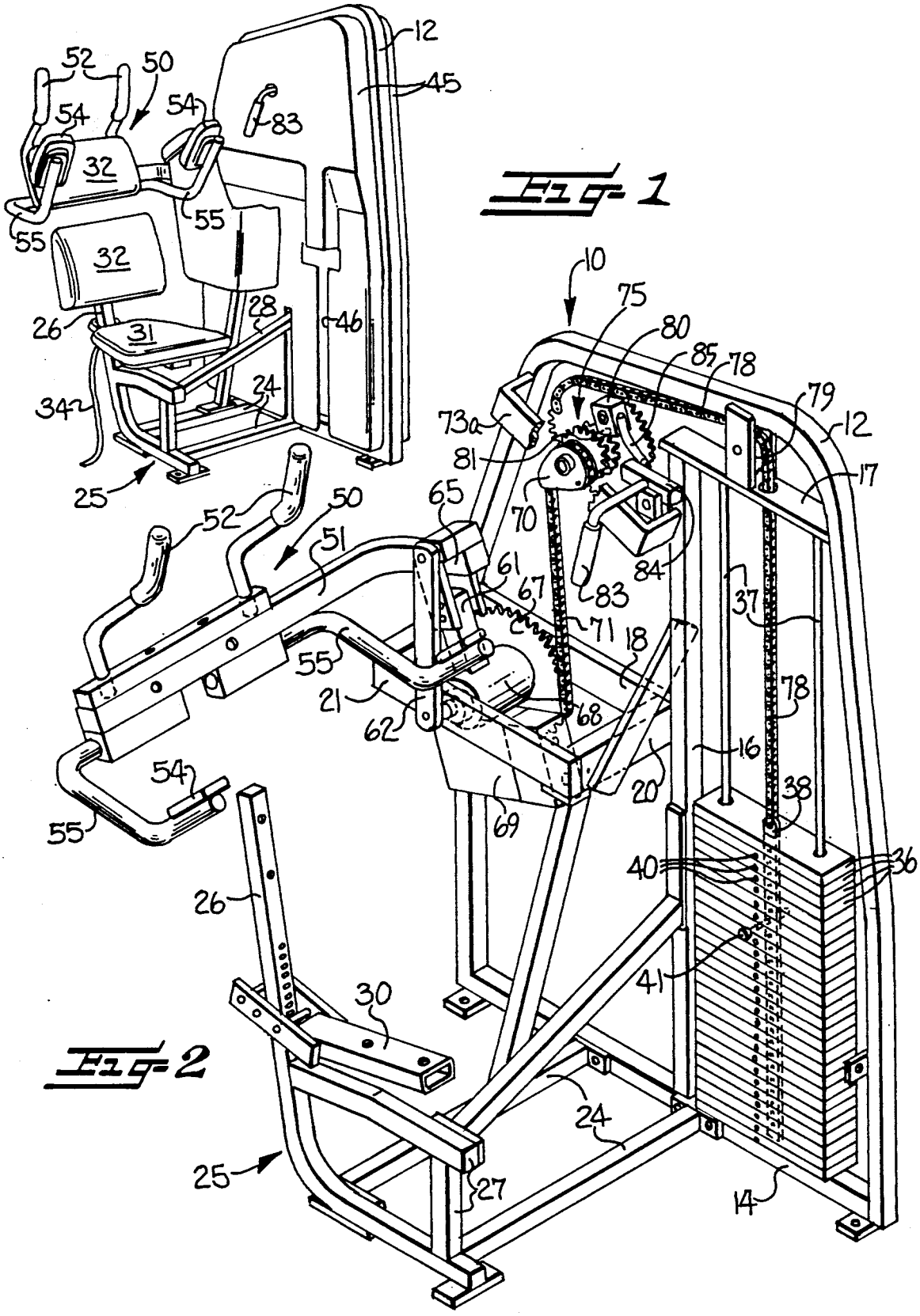
FIG. 1 is a perspective view of the torso exercise machine in accordance with a first embodiment of the invention wherein the exercise machine is adapted for exercising abdominal muscles.
FIG. 2 is an isometric view of the machine of FIG. 1, having the covers and padded portions removed from the frame and showing component parts of the machine.
Figure 3:
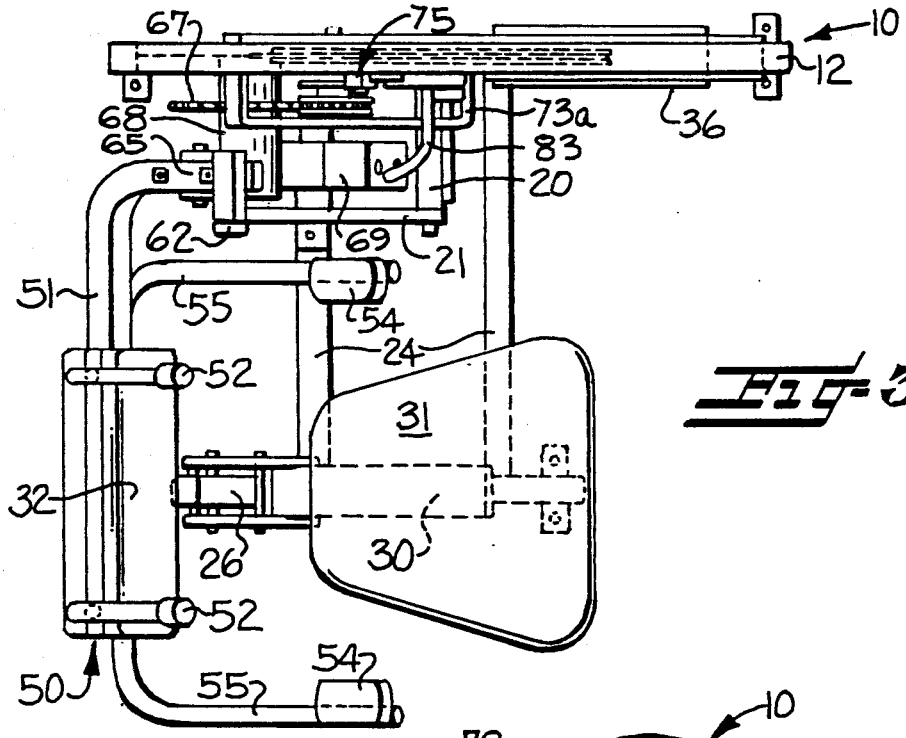
FIG. 3 is a plan view of the machine of FIG. 2, and having the padded seat included therewith.

Referring now to the drawings, and more particularly to FIGS. 1 through 10, there is illustrated a first embodiment of the torso exercise machine in accordance with the present invention which is adapted for exercising abdominal muscles. As best shown in FIG. 2, the exercise machine includes an upright frame, broadly indicated at 10. The upright frame 10 includes a continuous outer frame member 12 having a vertical rear leg, a horizontal upper part, and an inclined front leg. A lower horizontal frame member 14 is connected at opposite ends to the lower ends of the front and rear legs. A vertical frame member 16 is fixed at its lower end to the lower horizontal frame member 14 and at its upper end to a first cross frame member 17. A second cross frame member 18 extends between the vertical frame member 16 and the rear leg of the frame 10 and includes outwardly extending and spaced apart lateral support arms 20. A horizontal support member 21 connects the ends of the lateral support arms 20 to form a rectangular support structure extending on one side of the frame 10.

Two spaced lower horizontal support members 24 extend laterally from the frame member 14 of the frame 10 and are connected to a seat frame, broadly indicated at 25. A vertical support frame member 22 is fixed at its upper end at the juncture of the support arm 20 and the support member 21 and at its lower end to the rear support member 24. The seat frame 25 includes a main L-shaped support member 26 having vertical and horizontal brace members 27 fixed thereto. A diagonal brace member 28 connects the frame 10 with the horizontal seat frame brace member 27 to provide rigidity. The L-shaped support member 26 includes a vertically adjustable seat mount 30 on which a padded seat cushion 31 is attached (FIG. 1). A padded back cushion 32 is attached to the upper end portion of the vertical portion of the L-shaped support member 26. Restraining means in the form of a seat belt 34 is attached to the L-shaped support member 26 to provide restraint to a user seated on the machine.

Figure 4:
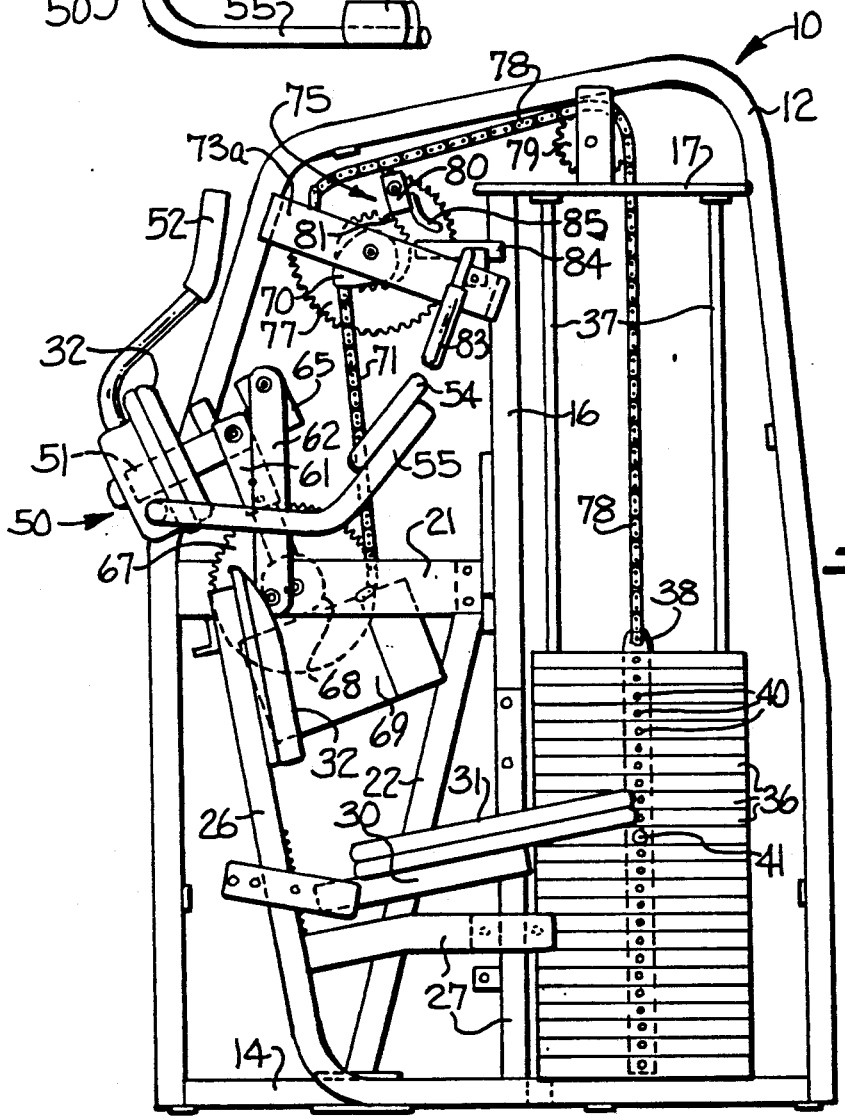
FIG. 4 is a side elevation view of the machine of FIG. 2, having the padded portions included.
Figure 5:
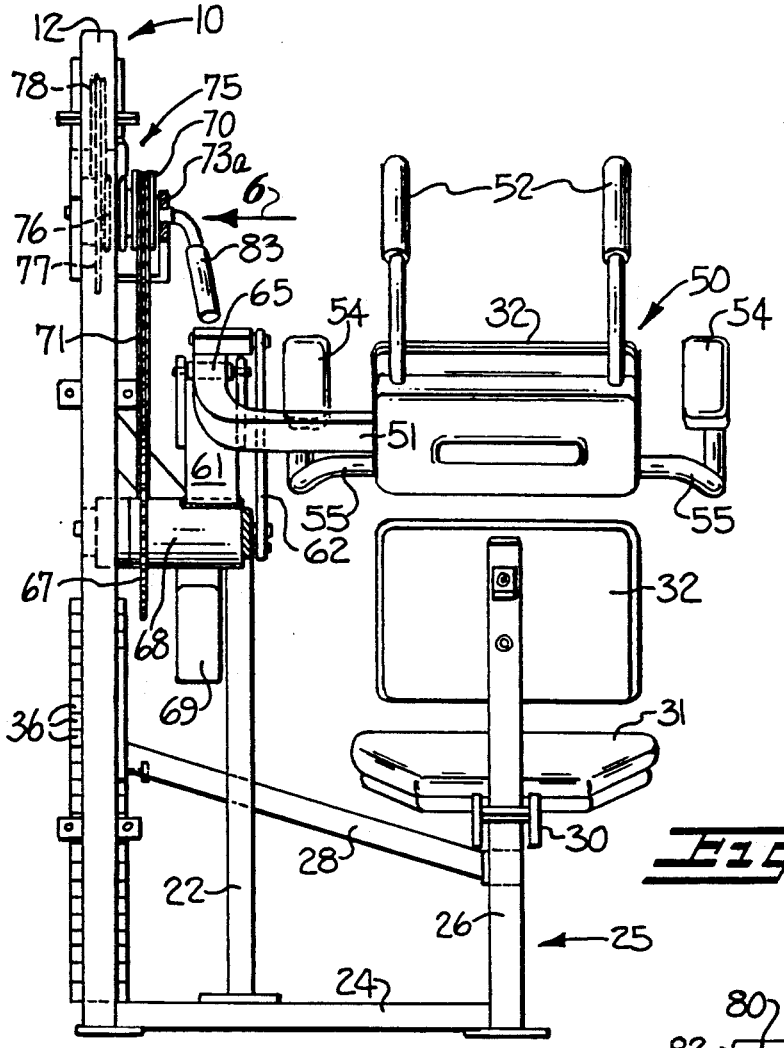
FIG. 5 is a rear elevation view of the machine of FIG. 2.

Resistance means is supported for vertical movement on the frame 10 and includes a plurality of weight plates 36 which are supported for sliding movement on spaced guide rods 37 (FIG. 4). The upper ends of the guide rods 37 are fixed on the first cross frame member 17 and their lower ends are fixed on the lower horizontal frame member 14. A vertical selector guide and weight lifting rod 38 extends through the central portion of the weight plates 36. The weight plates 36 are provided with horizontal openings 40 for reception of a selector pin 41 so that varying amounts of weight can be selected by the user to be lifted and lowered when exercising with the machine. A two-piece molded cover 45 is mounted on opposite sides of the frame 10 and includes a slot opening 46 for gaining access to the selector pin 41.

Body engaging means, in the form of an upper torso engaging member indicated generally at 50, is adapted for engaging at least the hands and arms of a user and receiving force therefrom for isolating and exercising abdominal muscles. The upper torso engaging member 50 includes a main support member 51 having vertically extending and spaced hand grips 52 extending upwardly and forwardly therefrom. Inclined elbow engaging pads 54 are supported on the forward ends of spaced tubular support braces 55.

The upper torso engaging member 50 is mounted on the frame 10 for back and forth pivotal movement about a horizontal pivot axis which is positioned to generally pass through the spine of the user. The upper torso engaging means moves in an eccentric path of travel so that an instantaneous axis of rotation is generated substantially along the spine of the user corresponding to the changing axis of rotation of the abdominal muscles and spine as the user flexes against the upper body engaging member 50.

Figure 10:
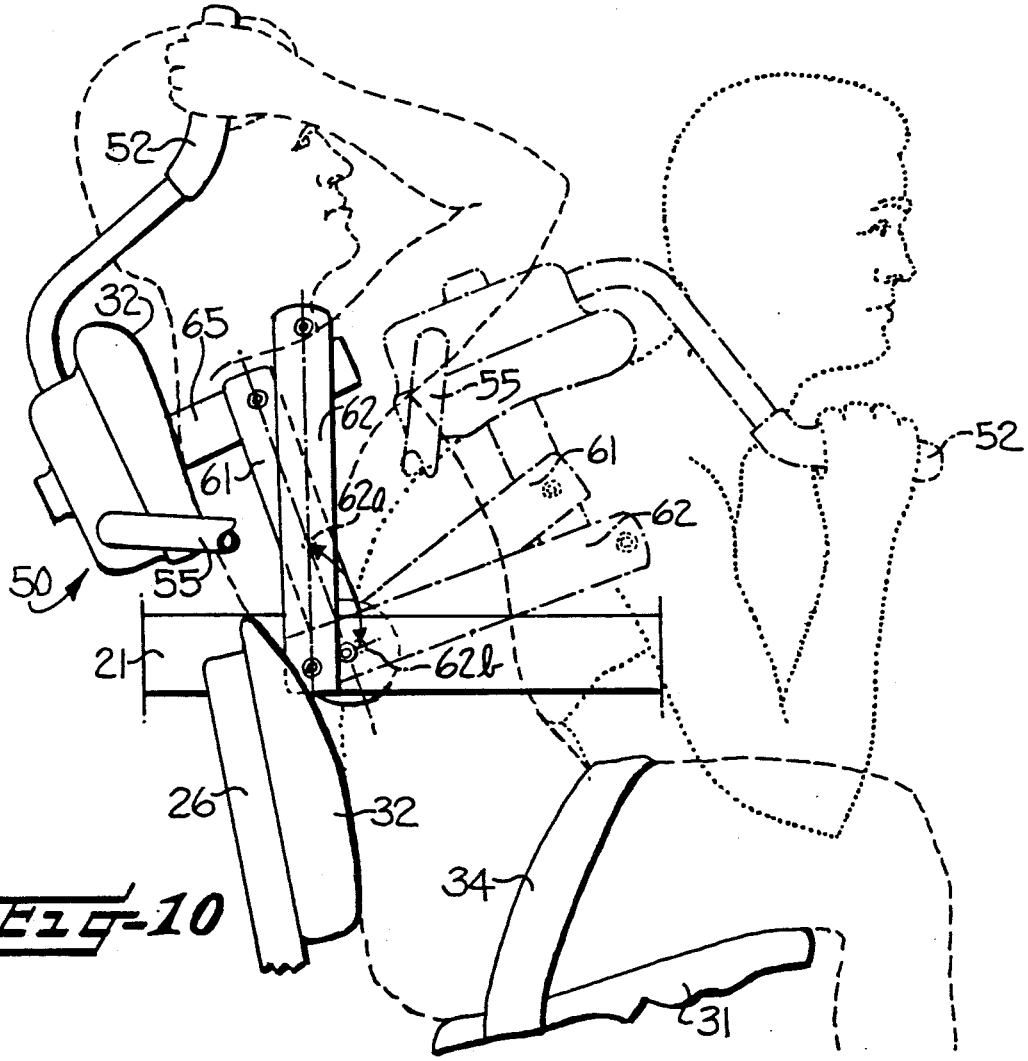
FIG. 10 is a schematic representation showing the back and forth exercise movement of a user with the exercise machine of the first embodiment of FIG. 1, and showing the change of center of rotation generated by the lever arms.

Means is provided for pivotally mounting the upper torso engaging member 50 for movement along the eccentric path of travel and includes first and second lever arms 61 and 62 having first upper ends mounted in spaced relation to each other on a forwardly extending portion of the main support member 57, which forms a third lever arm 65. The third lever arm 65 interconnects the upper ends of the first and second lever arms 61 and 62. A lever sprocket 67 and sprocket hub 68 are rotatably mounted on the frame 10 between the horizontal support brace member 21 and the second cross frame member 18. The lower end of the first lever arm 61 is fixed to the sprocket hub 68 and is pivotable about the central axis of the lever sprocket 67. The lower end of the second lever arm 62 is pivotally mounted on the horizontal support brace member 21 on an axis of rotation extending in rearward spaced, parallel relation with the central axis of the lever sprocket 67 so that the center lines of the first and second lever arms 61 and 62 cross each other (FIGS. 4 and 10). A counterweight 69 is fixed to the sprocket hub 68 and opposite the first lever arm 61. As the user moves the upper torso engaging member 50 back and forth along its path of travel, the lever arms 61 and 62 generate an instantaneous center to provide a different axis of rotation along the abdominal muscles of the user positioned in the seat 31. The changing axis of rotation corresponds to the changing axis of rotation of the abdominal muscles of the user as the user flexes from a somewhat rearwardly bent position (shown in dashed lines in FIG. 10) to a substantially forward, crouched position (shown in dotted lines in FIG. 10). This type of described structure for changing the axis of rotation commonly is referred to as a four-bar linkage. A wide variety of structures which change the axis of rotation can be used with the present invention.

The four-bar linkage generates an instantaneous center which is determined by the point at which the center lines of the first and second lever arms 61, 62 cross each other. In FIG. 10, the point at which the center lines cross each other (instantaneous center) is indicated at 62*a*, when the user is in the rearmost position. The point at which the center lines cross each other (instantaneous center) is indicated at 62*b*, when the user is in the forwardly crouched position. Thus, the instantaneous center moves downwardly and forwardly as the user bends forwardly and moves upwardly and rearwardly as the user bends rearwardly. A variable radius cam 70 is provided and is operatively connected between the lever sprocket 67 and the weight plates 36 to provide proper variable resistance for varying the amount of force required to be exerted by the user on the upper torso engaging member 50 in accordance with the position of the upper torso engaging member 50 along the eccentric path of travel. A chain 71 interconnects the front edge of the lever sprocket 67 with the variable radius cam 70.

Figure 6:
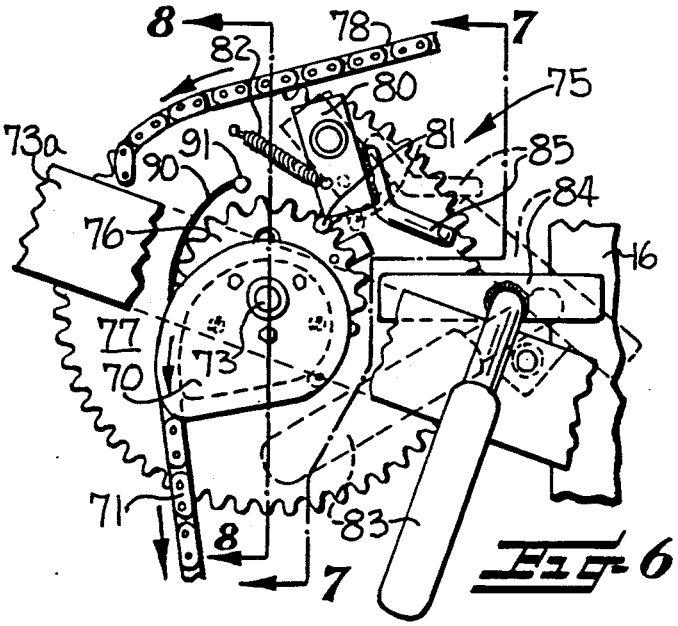
FIG. 6 is an enlarged fragmentary elevational view of the range limiter in accordance with the present invention looking in the direction of arrow 6 of FIG. 5.
Figure 7:
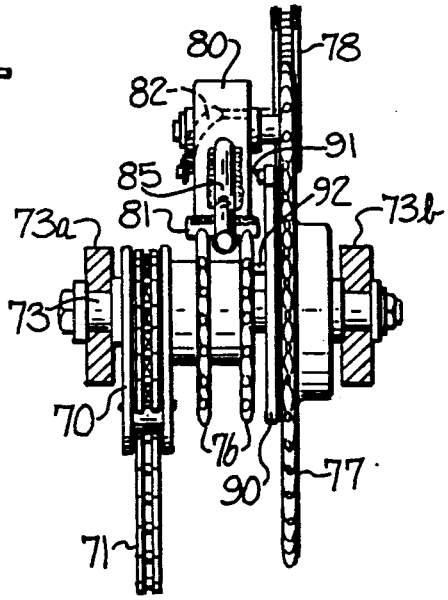
FIG. 7 is a vertical sectional view of the range limiter, taken along line 7—7 of FIG. 6.
Figure 8:
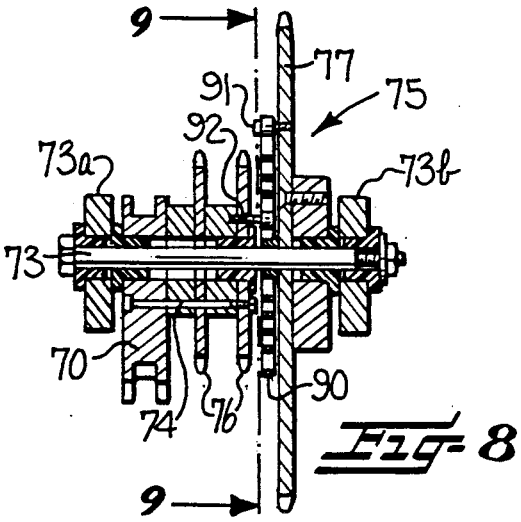
FIG. 8 is a vertical sectional view of the range limiter, taken along line 8—8 of FIG. 6.
Figure 9:
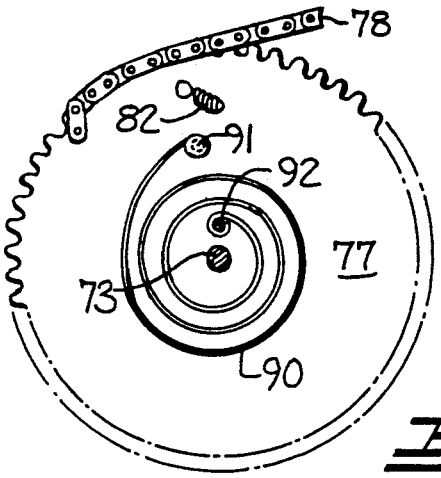
FIG. 9 is a vertical sectional view of the range limiter, taken along line 9—9 of FIG. 8.
Figure 11:
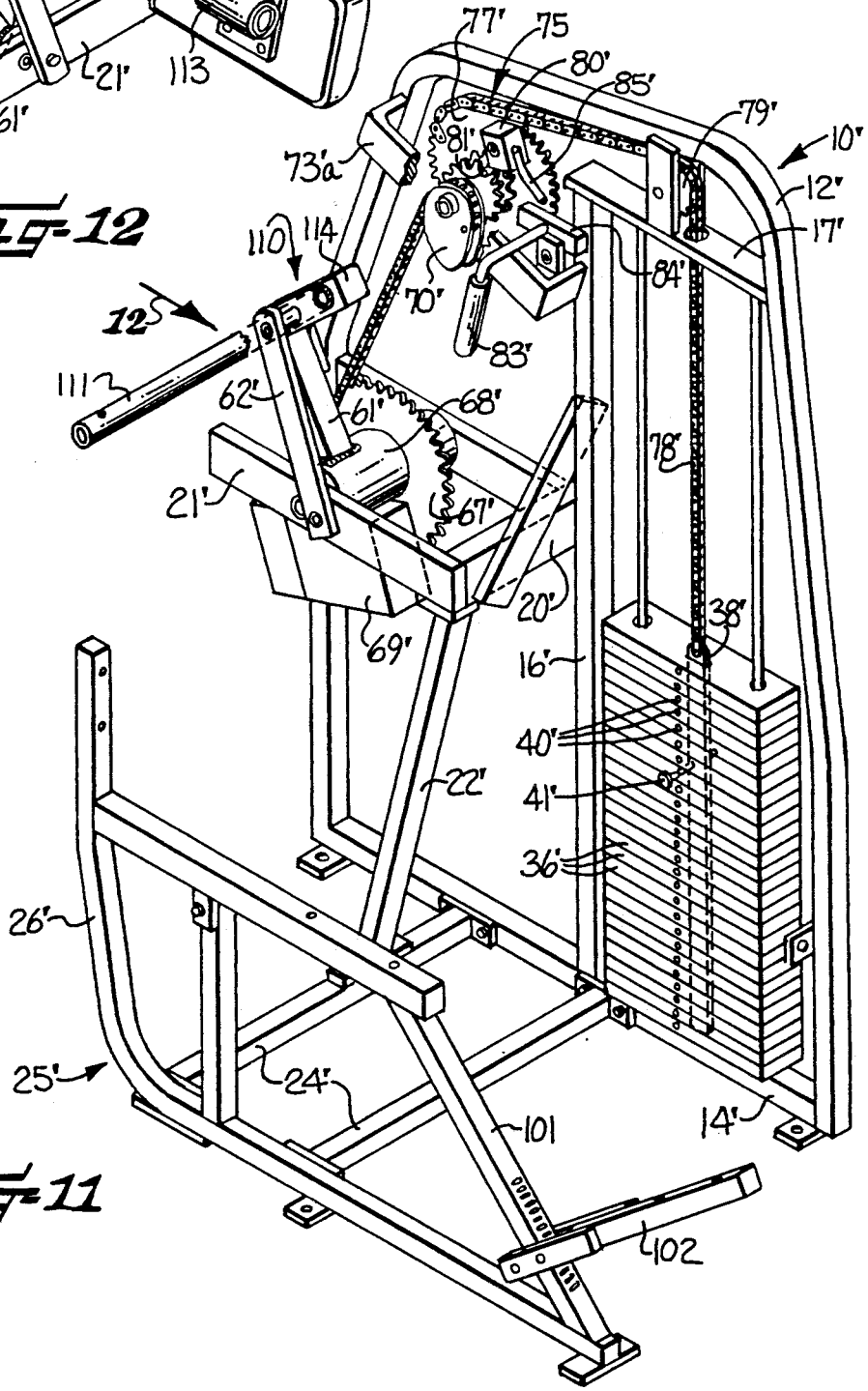
FIG. 11 is an isometric view similar to FIG. 2 but showing a second embodiment of the present invention wherein the exercise machine is adapted for exercising the muscles of the lower back.

As illustrated in greater detail in FIGS. 6 through 8, the variable radius cam 70 is mounted for rotational movement on a bolt forming a central shaft 73. Opposite ends of the bolt shaft 73 are supported in respective outer and inner cross frame members 73*a*, 73*b* (FIGS. 7 and 8). Range limiter means, broadly indicated at 75, is also supported on the shaft 73 and is provided for varying the starting position of the torso engaging member 50 and to thereby reduce its range of movement along the eccentric path of travel. The range limiter means 75 includes a first double tooth sprocket 76 mounted for rotation on the shaft 73 and fixed to the variable radius cam 70, as by a bolt 74 (FIG. 8). A second larger sprocket 77 is mounted for rotational movement on the shaft 73 and is operatively connected by a chain 78 to the weight lifting rod 38 extending through the weight plates 36. The chain 78 passes over an idler sprocket 79 (FIG. 11) supported above the cross frame member 17.

A pawl 80 is pivotally mounted to the second larger sprocket 77 and includes a latching tooth 81 dimensioned for receipt into the double row of teeth of the first sprocket 76. A tension spring 82 interconnects the pawl 80 and second sprocket 77 for biasing the pawl 80 into engagement with the teeth of the first sprocket 76. A hand lever, indicated generally at 83, is pivotally mounted to the frame 10 and includes a bar member 84 moveable with the hand lever for engaging an extension 85 of the pawl 80 for moving the pawl 80 out of engagement with the first sprocket 76 (FIG. 6). A spiral torsion spring 90 is mounted at one end, as indicated at 91 in FIG. 9, on the second sprocket 77 and includes a second end fixed on the first sprocket 76, as indicated at 92, for biasing the second sprocket 77 in a counterclockwise direction and to an initial starting position when the pawl 80 and latching tooth 81 is disengaged from the first sprocket 76.

The initial starting position of the torso engaging member 50 can be adjusted by the seated user moving the handle 83 in a clockwise direction to raise the pawl 80 and release the latching tooth 81 from engagement with the teeth of the first double teeth sprocket 76. The user then moves the torso engaging member 50 rearwardly to the desired starting exercise position. The handle 83 is then released to permit the latching tooth 81 to again engage the teeth of the first double teeth sprocket 76. This action provides a reorientation of the rotational position of the first double teeth sprocket 76 relative to the rotational position of the second sprocket 77 to adjust the starting position of the exercise and to accordingly adjust the range of operation of the torso engaging member 50.

Referring now to FIGS. 11–15, a second embodiment of the torso exercise machine of the present invention is illustrated which is constructed for exercising muscles of the lower back. Throughout the description of this second embodiment, the same reference numerals, with the prime notation added, will be used for corresponding elements described in the first embodiment of FIGS. 1–10.

Figure 12:
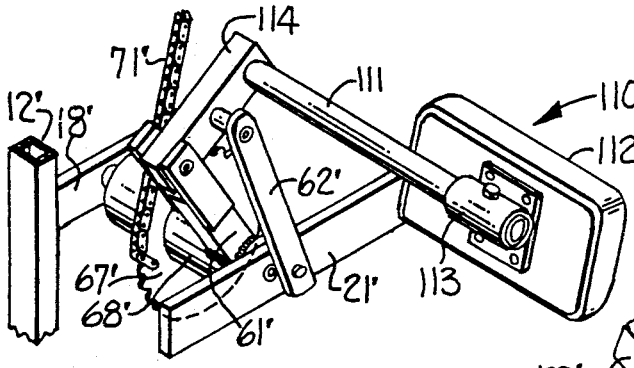
FIG. 12 is an enlarged isometric view of the lever arms and back engaging member, looking in the direction of arrow 12 of FIG. 11.
Figure 13:
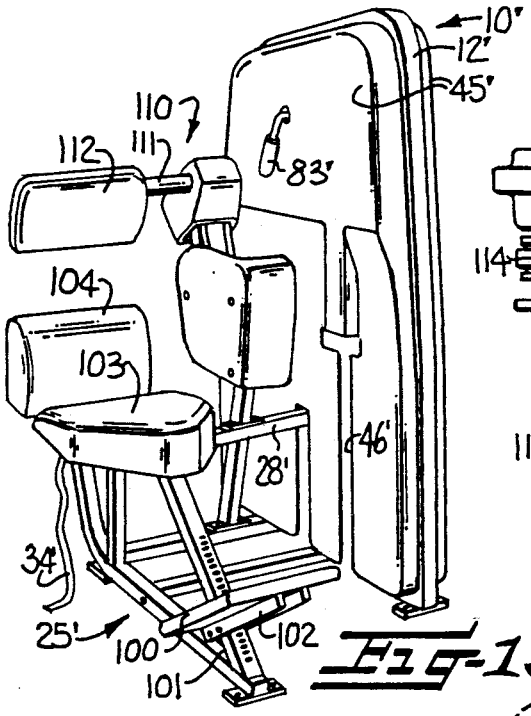
FIG. 13 is a perspective view of the second embodiment of the present invention, similar to the view shown in FIG. 1.
Figure 14:
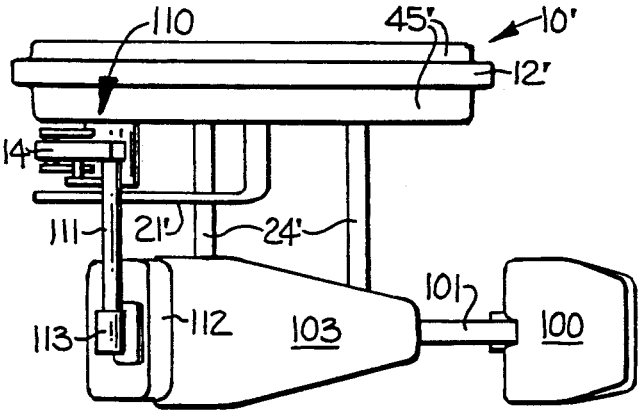
FIG. 14 is a plan view of the machine in accordance with the second embodiment, showing the cover in position on the machine.
Figure 15:
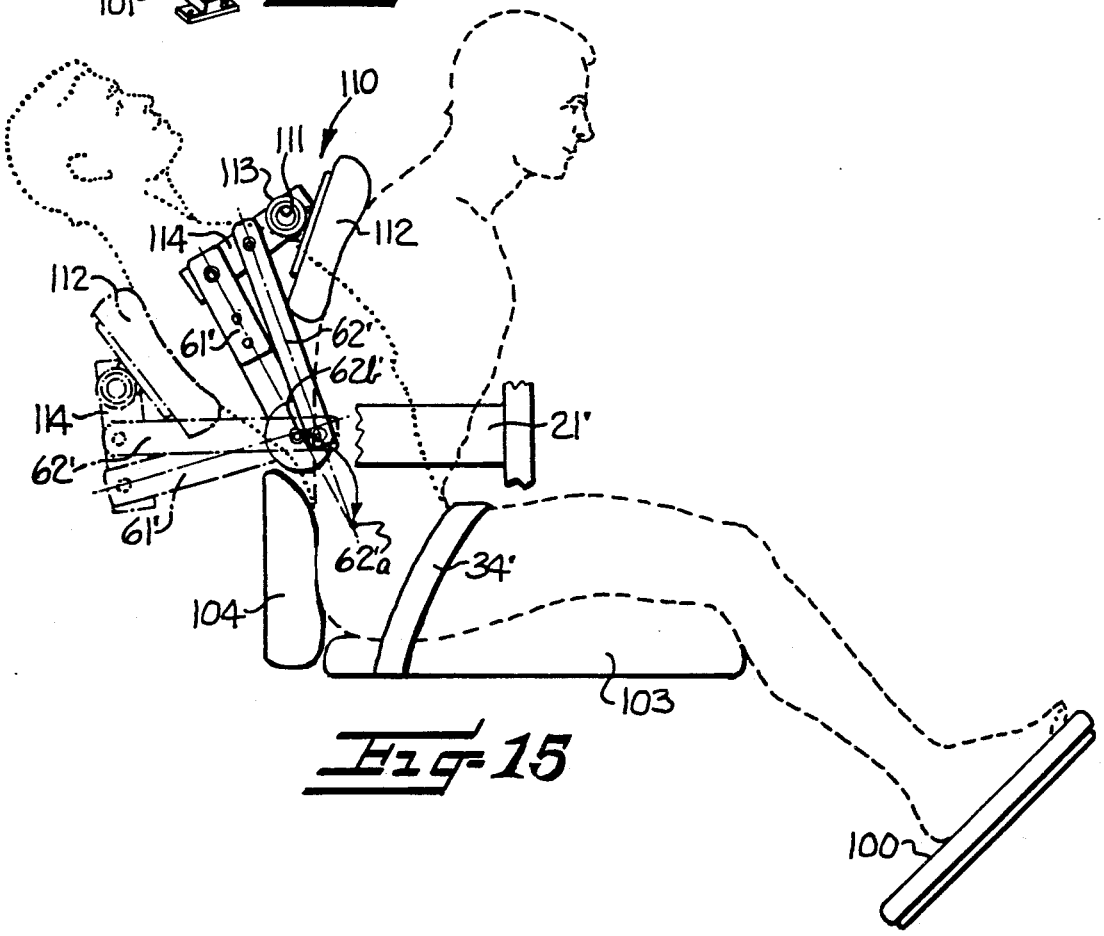
FIG. 15 is a schematic view showing the back and forth movement of a user during exercise of the lower back.

As illustrated, the seat frame 25′ includes a diagonal support bar 101 extending upwardly along a forward portion of the frame 10′. A foot rest support 102 is mounted for vertical adjustment on the support bar 101 and has a foot pad 100 fixed thereto. A padded seat 103 and a padded lower back rest 104 are supported on the L-shaped support member 26′ (FIGS. 13 and 14). As illustrated in FIG. 12, the chain 71′ interconnecting the lever sprocket 67′ and variable radius cam 70′ interconnects the rear edge of the lever sprocket 67′ so that back engaging means, illustrated generally at 110, operates to lift the weight plates 36′ when the back engaging means 110 is moved rearwardly by the user.

The back engaging means 110 includes a horizontal rod 111 having a back engaging pad 112 pivotally supported on the outer end portion by a collet 113. The inner end portion of the rod 111 is fixed in the forward end of a third lever arm 114 extending transverse to the horizontal rod 111. The back engaging means 110 also is mounted to the frame 10′ for pivotal back and forth movement about a horizontal pivot axis and along an eccentric path of travel. As in the first embodiment, first and second lever arms 61′ and 62′ support the back engaging means 110 so that an instantaneous axis of rotation is generated substantially along the spine of the user. The upper first ends of the lever arms 61′, 62′ are pivotally connected to the third lever arm 114. The lower end of the second lever arm 62′ is pivotally connected to the horizontal support brace member 21′ on an axis of rotation extending forwardly of and in spaced, parallel relation to the central rotational axis of the sprocket hub 68′.

In this lower back exercising machine, the center lines of the first and second lever arms 61′, 62′ of the four-bar linkage do not cross within the length of the lever arms 61′, 62′, as they did in the abdominal exercise machine of the first embodiment. Instead, the center lines of the lever arms 61′, 62′ cross at a first instantaneous center 62*a*′ (FIG. 15) positioned below the lower pivot points of these lever arms 61', 62' when the user is in the forward dashed line position. When the user moves the upper portion of the body rearwardly to the dotted lines position, the instantaneous center moves to a second position 62b', moving along the curved line indicated in FIG. 15 and connecting the first and second positions 62a', 62b'.

Method of Operation

In the abdominal exercising machine of the first embodiment illustrated in FIGS. 1–10, the user is positioned in the seat 31 and straps the seat belt 34 across his upper thighs (FIG. 10). The user places his elbows on the elbow engaging pads 54 and grips the vertically extending hand grips 52, as shown in dashed lines in FIG. 10. If a full range of movement is not desired, such as in the case of user having an injury and needing rehabilitation, the range limiter hand lever 83 can be moved to disengage the latching tooth 81 of the pawl 80 from the first double teeth sprocket 76. The user then presses forwardly on the elbow engaging pads 54 and the hand grips 52 to move the upper torso engaging member 50 a predetermined distance along the eccentric path of travel to a desired starting position. The hand lever 83 is then released to engage the latching tooth 81 of the pawl 80 with the double row of teeth on the first sprocket 76 to reorient the rotational position of the variable cam 70 relating to the second sprocket 77. The user then selects the desired resistance by inserting the selector pin 41 into the desired opening 40 to engage the weight plates 36 with the weight lifting rod 38. The user pulls the upper torso engaging member 50 forwardly and moves from a first somewhat rearwardly bent position (as shown in dashed lines in FIG. 10) to a second position where the user is in a somewhat upright forward, crouched position (as shown in dotted lines in FIG. 10). The user repeats the cycle for as many repetitions as necessary for the exercise program. During the exercise movement the axis of movement and the instantaneous center changes as indicated by the double headed arrow in FIG. 10.

In the second embodiment illustrated in FIGS. 11–15, the user straps himself in the seat as before. The desired weight is selected and the desired starting position is selected by moving the handle 83' to disengage the pawl 80' from the teeth of the first sprocket 76' to vary the starting position of the back engaging means 110. During the exercise movement, the user presses against the back engaging means 110 to move between the first position with the spine of the user in a forwardly bent position, shown in dashed lines in FIG. 15, and a second position with the spine of the user in a rearwardly bent position, shown in dotted lines in FIG. 15. The user repeats the cycle for as many repetitions as necessary during the exercise program.

The present invention offers several benefits over other prior art exercise machines. The structure of the lever arms generates an instantaneous (changing or moving) axis of rotation substantially along the vertebrae of the spine. This instantaneous center corresponds to the changing axis of rotation for the isolated and exercised torso portion, such as the lower back and abdominal muscles, as the user flexes against the upper body engaging means. Thus, exercise efficiency is increased and the possibility of injury during the exercise movement is lessened because there is rotation about the spine, and not the hip joint. Additionally, the range limiter means varies the starting position of the upper torso engaging means and reduces the range of movement along the path of travel. This especially is beneficial for those users which are rehabilitating old injuries where the full range of exercise movement is not desirable.

In the drawings and specification, there has been set forth the best modes presently contemplated for the practice of the present invention, and although specific terms are employed, they are used in a descriptive sense only and not for purposes of limitation, the scope of the invention being defined in the claims.

That which is claimed is

1. A torso exercise machine comprising a frame, a seat connected to said frame for supporting a user in a seated position thereon, an upper body engaging member adapted for engaging a portion of the upper body of the user, means pivotally mounting said body engaging member to said frame for back and forth movement about a horizontal pivot axis which is positioned to generally pass through the spine of the user when seated upon said seat and which moves in a generally vertical direction during such pivotal movement and so as to generally follow the changing axis of rotation of the spine of the user during corresponding movement of the user, resistance means, and means operatively connecting said mounting means to said resistance means for transmitting the pivotal movement of said body engaging member to movement of said resistance means to thereby exercise the torso of the user against the force of said resistance means.

2. A torso exercise machine comprising a frame, a seat connected to said frame for supporting a user in a seated position thereon, upper body engaging means adapted for engaging an upper body part of a user and receiving force from the upper body part for exercising an isolated portion of the torso, means pivotally mounting said upper body engaging means to said frame for pivotal back and forth movement of said upper body engaging means about a horizontal pivot axis and along an eccentric path of travel, said pivotal mounting means generating an instantaneous axis of rotation substantially along the isolated portion of the torso of a user positioned in said seat, said instantaneous axis of rotation corresponding to the changing axis of rotation of the isolated and exercised torso portion as the user flexes against said upper body engaging means, resistance means for opposing movement of the user while the user is positioned on said seat, and means operatively connecting said mounting means to said resistance means for transmitting movement of said upper body engaging means to said resistance means for isolating and exercising an isolated portion of the torso against the force imposed by said resistance means.

3. A torso exercise machine according to claim 2 wherein said pivotal mounting means includes first and second lever arms, means pivotally mounting a first end of each lever arm in spaced relation to each other on said upper body engaging means, and means pivotally mounting the second ends of said lever arms in spaced relation to each other on said frame so that the instantaneous axis of rotation of said upper body engaging means is moved as said upper body engaging means is moved along the eccentric path of travel.

4. A torso exercise machine according to claim 3 including a sprocket, a sprocket hub fixed to said sprocket and rotatably mounted on said frame, said second end of said first lever arm being fixed to said sprocket hub and pivotable about the central axis of said sprocket hub, said second end of said second lever arm being pivotally mounted on said frame on an axis of rotation extending in spaced, parallel relation with the central axis of said sprocket hub.

5. A torso exercise machine according to claim 4 including means interconnecting said sprocket to said resistance means.

6. A torso exercise machine according to claim 3 wherein said upper body engaging means includes a third lever arm pivotally connecting the first ends of said lever arms.

7. A torso exercise machine according to claim 3 wherein said lever arms cross each other.

8. A torso exercise machine according to claim 2 wherein said means operatively connecting said pivotal mounting means to said resistance means includes a variable radius cam rotatably moveable with said upper body engaging means, said variable radius cam being operatively connected to said resistance means for varying the amount of force required to be exerted by a user on said upper body engaging means in accordance with the position of said upper body engaging means along said eccentric path of travel.

9. A torso exercise machine according to claim 8 including means releasably connecting said variable radius cam and said resistance means for disengaging said variable radius cam from said resistance means for varying the starting position of said upper body engaging means along said eccentric path of travel.

10. A torso exercise machine according to claim 2 wherein said resistance means comprises weight means supported for vertical movement on said frame to provide resistance through lifting and lowering.

11. A torso exercise machine according to claim 2 wherein said mounting means pivotally connects said upper body engaging means to said frame at a position above the level of said seat

12. A machine for exercising muscles of the lower back comprising:

a frame, a seat connected to said frame for supporting a user in a seated position thereon, means for engaging the back of a user while the user is positioned on said seat for receiving force from the user for isolating and exercising muscles of the lower back, means mounting said back engaging means for pivotal back and forth movement of said back engaging means about a horizontal pivot axis and along a defined path of travel, said mounting means including first and second lever arms, means pivotally mounting a first end of each of said lever arms on said back engaging means, and means pivotally mounting a second end of each of said lever arms on said frame so that said first ends of said lever arms are moveable in eccentric paths of travel upon sufficient force being directed by a user on said back engaging means, said lever arms being mounted on said back engaging means for generating an instantaneous axis of rotation substantially along the spine of a user positioned in said seat, said changing axis of rotation corresponding to the changing axis of rotation of the lower back of the user as the user flexes against said back engaging means, resistance means for opposing movement of a user while the user is positioned on said seat, and means operatively connecting said first and second lever arms to said resistance means for transmitting movement of said back engaging means to said resistance means, said operative connecting means including variable radius cam means rotatable with said lever arms and back engaging means wherein said variable radius cam means is operatively connected to said resistance means for varying the amount of force required to be exerted by the user on said back engaging means in accordance with the position of said back engaging means along said path of travel.

13. An exercise machine according to claim 12 wherein said back engaging means is moveable in an eccentric path of travel between a first position with the spine of a user in a forwardly bent position and a second position with the spine of a user in a rearwardly bent position.

14. An exercise machine according to claim 12 including, a first sprocket means operatively connected to said variable radius cam means, a second sprocket means operatively connected to said resistance means, and means releasably connecting said first and second sprocket means for disengaging said variable radius cam means from said resistance means for varying the starting position of said back engaging means along said path of travel.

15. An exercise machine according to claim 12 including a sprocket, a sprocket hub fixed to said sprocket and rotatably mounted on said frame, said first lever arm having a second end fixed to said sprocket hub and pivotable about the central axis of said sprocket, said second lever arm having a second end pivotally mounted on said frame on an axis of rotation extending in spaced, parallel relation with the central axis of said sprocket hub.

16. An exercise machine according to claim 15 including means interconnecting said sprocket to said variable radius cam means.

17. An exercise machine according to claim 12 wherein said back engaging means includes a third lever arm pivotally connecting said first ends of said lever arms.

18. An exercise machine according to claim 12 wherein said resistance means comprises weight means supported for vertical movement on said frame to provide resistance through lifting an lowering.

19. An exercise machine according to claim 12 wherein said lever arms pivotally connect said back engaging means to said frame at a position above the level of said seat.

20. A machine for exercising abdominal muscles comprising, a frame, a seat connected to said frame for supporting a user in a seated position thereon, upper torso engaging means for engaging at least the arms of a user and receiving force therefrom for isolating and exercising abdominal muscles, means mounting said upper torso engaging means for pivotal back and forth movement about a horizontal pivot axis and along a defined path of travel, said mounting means including first and second lever arms, means pivotally mounting a first end of each of said lever arms on said upper torso engaging means and means pivotally mounting a second end of each of said lever arms on said frame so that said first ends of said lever arms are moveable in eccentric paths of travel upon sufficient force being directed by a user on said upper torso engaging means, said lever arms being mounted on said upper torso engaging means for generating an instantaneous axis of rotation substantially along the abdominal muscles of a user positioned in said seat, said changing axis of rotation substantially corresponding to the changing axis of rotation of the abdominal muscles of the user as the user flexes from a substantially extended position to a substantially forward, crouched position, resistance means for opposing movement of the user while the user is positioned on said seat, and means operatively connecting said first and second lever arms to said resistance means for transmitting movement of said upper torso engaging means to said resistance means, said operative connecting means including a variable radius cam means rotatable with upper torso engaging means wherein said variable radius cam means is operatively connected to said resistance means for varying the amount of force required to be exerted by the user on said upper torso engaging means in accordance with the position of said upper torso engaging means along said path of travel.

21. An exercise machine according to claim 20 wherein said upper torso engaging means is moveable in an eccentric path of travel between a first position where the user is in a substantially extended position and a second position where the user is in a forward, crouched position.

22. An exercise machine according to claim 20 including, a first sprocket means operatively connected to said variable radius cam means, second sprocket means operatively connected to said resistance means, and means releasably connecting said first and second sprocket means for disengaging said variable radius cam means from said resistance means for varying the starting position of said upper torso engaging means along said path of travel.

23. An exercise machine according to claim 20 wherein said lever arms pivotally connect said upper torso engaging means to said frame at a position above the level of said seat.

24. An exercise machine according to claim 20 wherein said resistance means comprises weight means supported for vertical movement to provide resistance through lifting and lowering.

25. An exercise machine according to claim 20 including a sprocket, a sprocket hub fixed to said sprocket and rotatably mounted on said frame, said first lever arm having a second end fixed to said sprocket hub and pivotable about the central axis of said sprocket, said second lever arm having a second end pivotally mounted on said frame on an axis of rotation extending in spaced, parallel relation with the central axis of said sprocket.

26. An exercise machine according to claim 25 including means interconnecting said sprocket to said variable radius cam means.

27. An exercise machine according to claim 20 wherein said upper torso engaging means includes a third lever arm pivotally connecting said first ends of said lever arms.

28. An exercise machine according to claim 20 wherein said lever arms cross each other.

* * * * *